US008521532B2

(12) United States Patent
Otani

(10) Patent No.: US 8,521,532 B2
(45) Date of Patent: Aug. 27, 2013

(54) SPEECH-CONVERSION PROCESSING APPARATUS AND METHOD

(75) Inventor: Michiaki Otani, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 1374 days.

(21) Appl. No.: 11/651,916

(22) Filed: Jan. 10, 2007

(65) Prior Publication Data

US 2007/0162284 A1 Jul. 12, 2007

(30) Foreign Application Priority Data

Jan. 10, 2006 (JP) ..... 2006-003104

(51) Int. Cl.
*G10L 13/08* (2006.01)

(52) U.S. Cl.
USPC ..... 704/260; 704/251; 704/257

(58) Field of Classification Search
USPC ..... 704/258, 260, 270, 251, 255, 257, 704/1–10, 270.1
See application file for complete search history.

(56) References Cited

U.S. PATENT DOCUMENTS

| | | | | |
|---|---|---|---|---|
| 5,652,828 | A * | 7/1997 | Silverman et al. | 704/260 |
| 5,732,395 | A * | 3/1998 | Silverman et al. | 704/260 |
| 5,761,640 | A * | 6/1998 | Kalyanswamy et al. | 704/260 |
| 5,893,901 | A * | 4/1999 | Maki | 704/260 |
| 6,012,028 | A * | 1/2000 | Kubota et al. | 704/260 |
| 6,708,150 | B1 * | 3/2004 | Hirayama et al. | 704/243 |
| 6,778,961 | B2 | 8/2004 | Walker et al. | |
| 7,219,063 | B2 * | 5/2007 | Schalk et al. | 704/270.1 |
| 7,242,752 | B2 | 7/2007 | Chiu | |
| 7,623,648 | B1 * | 11/2009 | Oppenheim et al. | 379/218.01 |
| 2004/0030554 | A1 * | 2/2004 | Boxberger-Oberoi et al. | 704/260 |

FOREIGN PATENT DOCUMENTS

| | | |
|---|---|---|
| JP | 08-305542 | 11/1996 |
| JP | 09-204434 | 8/1997 |
| JP | 01-325191 | 11/2001 |
| JP | 02-207728 | 7/2002 |
| JP | 03-329458 | 11/2003 |
| JP | 04-326367 | 11/2004 |
| JP | 07-527640 | 9/2007 |
| WO | WO 2005/006116 | 1/2005 |

* cited by examiner

*Primary Examiner* — Huyen X. Vo
(74) *Attorney, Agent, or Firm* — Brinks Hofer Gilson & Lione

(57) ABSTRACT

An address character-string structure analyzer analyzes an address character-string structure with respect to address data selected from input data for speech conversion, in accordance with data stored in the address speech-conversion application-rule data storage section. A street speech-conversion structure data element divider divides the address data into structure elements. A street-name speech-conversion pronunciation symbol dictionary is provided. When the structure elements contain a street name, an address speech-conversion data-storage-section selector/reader searches the dictionary and reads pronunciation symbols for the street name. For another structure element, a general dictionary, an individually-created general dictionary, individually-created phonetic-symbol dictionary, or the like is searched and pronunciation symbols are read. When the processing for all elements is completed, speech data is created and reproduced in accordance with general speech data.

16 Claims, 10 Drawing Sheets

FIG. 3A

| EXAMPLE OF PRONUNCIATION SYMBOLS | |
|---|---|
| PLAIN TEXT | PRONUNCIATION SYMBOLS |
| San Jose | SAN NOZEI |
| Torrance, CA | TORANSU, KYALUFORUNIA |

FIG. 3B

| EXAMPLE OF TTS DICTIONARY | |
|---|---|
| PLAIN TEXT | MEANING : PRONUNCIATION |
| ST | Street : SUTORÎTO |
| AVE | AVENYU |

FIG. 3C

EXAMPLE OF ADDRESS TEXT DATA

[100 St Lantana St, Los Angeles, CA]

[Would you like to calculate a route to St Lantana St?]

FIG. 3D

| EXAMPLE OF CONVERSION APPLICATION RULE (ADDRESS CHARACTER-STRING STRUCTURE) | CORRESPONDING ACTUAL EXAMPLE |
|---|---|
| STATE | CA |
| CITY | Los Angeles |
| STREET | St Lantana |
| ROAD TYPE | St |
| STREET NUMBER | 100 |
| FACILITY (POI) NAME | City Bank |

FIG. 3E

EXAMPLE OF STREET-NAME SPEECH-CONVERSION PRONUNCIATION SYMBOL

| STREET NAME | EXAMPLE OF PRONUNCIATION SYMBOL |
|---|---|
| HWY | HAIUEI |
| LA | LA |
| OH– | ÔEICHI |
| St Lantana | SENTO LANTANA |
| ⋮ | ⋮ |

FIG. 4

| EXAMPLE OF SPEECH DATA FOR STREET-NAME SPEECH-CONVERSION | | | |
|---|---|---|---|
| TXT | PRONUNCIATION | TXT | PRONUNCIATION |
| AB | EI BI | NC | ENU SÎ |
| AL | EI ELU | ND | ENU DÎ |
| AR | EI ÂRU | NE | ENU Î |
| AUT | EI YÛ TÎ | NH | ENU EICHI |
| AZ | EI ZÎ | NJ | ENU JEI |
| BC | BÎ SÎ | NM | ENU EMU |
| CA | SÎ EI | NV | ENU VÎ |
| CO | SÎ Ô | NY | ENU WAI |
| CR | SÎ ÂRU | OH | Ô EICHI |
| CT | SÎ TÎ | OK | Ô KEI |
| DC | DÎ SÎ | ON | Ô ENU |
| DE | DÎ Î | OR | Ô ÂRU |
| ETR | Î TÎ ÂRU | PA | PÎ EI |
| FL | EFU ELU | QEW | KYÛ Î DABURYU |
| GA | ZÎ EI | RI | ÂRU AI |
| HWY | HAIUEI | RTE | ÂRU TÎ Î |
| IA | AI EI | SC | ESU SÎ |
| ID | AI DÎ | SD | ESU DÎ |
| IL | AI ELU | SK | ESU KEI |
| IN | AI ENU | TN | TÎ ENU |
| KS | KEI ESU | TRC | TÎ ÂRU SÎ |
| KY | KEI WAI | TX | TÎ EX |
| LA | LA | US | Û ESU |
| MA | EMU EI | UT | Û TÎ |
| MB | EMU BÎ | VA | VÎ EI |
| MD | EMU DÎ | VT | VÎ TÎ |
| ME | EMU Î | WA | DABURYU EI |
| MI | EMU AI | WI | DABURYU AI |
| MN | EMU ENU | WV | DABURYU VÎ |
| MO | EMU OU | WY | DABURYU WAI |
| MS | EMU ESU | SR | ESU ÂRU |
| MT | EMU TÎ | RT | ÂRU TÎ |

FIG. 6A

| EXAMPLE OF STREET-NAME SPEECH-CONVERSION REFERENCE LIST | |
|---|---|
| 1 | HWY |
| 2 | LA |
| 3 | OH– |
| 4 | St Lantana |
| | ⋮ |

FIG. 6B

| EXAMPLE OF TTS DICTIONARY CORRESPONDING TO REFERENCE LIST | |
|---|---|
| 1 | HAIUEI |
| 2 | LA |
| 3 | ÔEICHI |
| 4 | SENTO LANTANA |
| | ⋮ |

FIG. 9A

| | |
|---|---|
| (EXAMPLE OF PRONUNCIATION SYMBOLS FOR GENERAL PROCESSING OF EXPRESSWAY NUMBER) | |
| I - 110 | AI WAN-HANDOREDDO-TEN |
| (EXAMPLE OF PRONUNCIATION SYMBOLS FOR SPACE PROCESSING OF EXPRESSWAY NUMBER) | |
| I - 1 10 | AI WAN TEN |

FIG. 9B

| STATE ABBREVIATION/PROPER-NAME CONVERSION DICTIONARY | | PRONUNCIATION SYMBOLS |
|---|---|---|
| STATE ABBREVIATION | PROPER NAME | |
| CA | California | KYALUFORUNIA |
| OH | Ohio | OHAIO |

SPEECH-CONVERSION PROCESSING APPARATUS AND METHOD

RELATED APPLICATIONS

The present application claims priority to Japanese Patent Application Serial Number 2006-003104, filed on Jan. 10, 2006, the entirety of which is hereby incorporated by reference.

BACKGROUND OF THE INVENTION

1. Field of the Invention

The present invention relates to a speech-conversion processing apparatus for performing processing for converting text data into speech in order to allow, for example, a navigation apparatus to give various types of voice guidance to a user.

2. Description of the Related Art

For example, in order to perform various types of guidance, such as confirmation of voice recognition, confirmation of destination setting, and read-aloud intersection names, vehicle navigation apparatuses give voice guidance in addition to visual guidance using display screens. In vehicles in particular, in many cases, the users of such navigation apparatuses are the drivers and thus cannot stare at the display screens while driving, thus making voice guidance essential. Such voice guidance/read-aloud is not limited to navigations apparatuses and used in a wide variety of fields.

For performing voice guidance as described above, text data that contains character strings indicating contents for voice guidance is created and is divided into words, which are sound elements, and speech data for each word is created with reference to a pre-stored dictionary. Further, the individual words are associated with each other, intonation is added thereto, and resulting data is subjected to various types of necessary processing, and speech (i.e., voice) is generated. In order to perform such various types of processing, speech-conversion processing apparatuses employing TTS (text to speech) technologies have been widely used.

In such a know speech-conversion processing apparatus, a pre-stored general dictionary database, which serves as a TTS dictionary, is used with respect to plain-text data containing input character strings. The dictionary database is created so as to cover as wide a range of fields as possible, based on the premise that the speech-conversion processing apparatus is to be used in a wide range of fields. Yet, when the dictionary database is used for navigation-apparatus speech guidance in which unique words associated with map data, vehicle driving, traffic guidance, and so on are used, the general-purpose dictionary database cannot serve the purpose and may not be able to perform appropriate read-aloud/voice guidance, thus often falling short of the user's expectation.

That is, for example, in a navigation apparatus, with respect to unique words that are not stored in a general dictionary and that are used in the navigation apparatus, in some cases, pronunciation symbols used in a general database are used in response to character strings desired to be read aloud and are sent to a speech-conversion processing apparatus. In this case, as shown in FIG. 3A, when plain text "San Jose" which is supposed to be pronounced "san nozei" is received as character strings (it is to be noted that pronunciation symbols, such as "san nozei", used herein are based on a modified version of a writing system called "Romaji", which was originally developed to write Japanese characters by using Latin alphabets), the known navigation apparatus may pronounce it, for example, "san jyoze" by using a general dictionary and thus may not correctly pronounce it. In such a case, storing pronunciation symbols "san nozei" allows it to be correctly pronounced upon the receipt of the plain text. Similarly, for plain text "Torrance, Calif.", storing pronunciation symbols "tôransu, kyaluforunia" allows it to be correctly pronounced.

For a vehicle navigation apparatus, since map data are used and the vehicle travels in wide areas, guidance of addresses constituted by collections of place names is essential. However, since place names are often represented by unique abbreviations or pronounced in unique ways, such variations cannot often be dealt with by a general dictionary that is provided in a speech-conversion processing apparatus by a company manufacturing the navigation apparatus, and thus, an additional TTS dictionary may be prepared. Accordingly, place names are assigned additional information and stored such that, for example, "St" represents the abbreviation of "Street" and/or "St" is pronounced "sutorîto", as shown in FIG. 3B. Similarly, "Ave" is stored so as to be pronounced "avenyu".

Japanese Unexamined Patent Application Publication No. 9-152893 discloses a technology for speech-conversion processing of place names. In this patent publication, place-name dictionaries are prepared for respective predetermined areas, an area of a place-name dictionary is selected based on the data of the current position of a navigation apparatus so as to prevent place-name pronunciations used in other areas from being read aloud.

In particular, in many cases, voice guidance performed by navigation apparatuses involve addresses constituted by collections of place names, and place names in addresses in many countries are often pronounced differently even for the same representation, i.e., for the same text. Thus, in addition to the above-noted general dictionary provided in a speech-conversion processing apparatus, a separate pronunciation-symbol dictionary in which pronunciation symbols are stored in association with specific place names may be created or a TTS dictionary in which proper names of specific abbreviations or pronunciation symbols therefor are stored may be used. Yet, even the use of such dictionaries cannot provide satisfactory results in many cases.

That is, pronunciation symbols used for the reading aloud of addresses are supplied from a database vender, which manufactures a database for the pronunciation symbols, and are stored in the database for use. However, since database venders handle diverse place names, they may create databases without necessarily confirming place names in the addresses of specific cities and towns and the abbreviations of places names. Therefore, there are cases in which the pronunciation symbols supplied from the database venders are wrong.

With only a TTS dictionary as described above, conversion rules defined by the TTS dictionary are applied to all words in character strings to be read aloud. Thus, for example, when the character strings of names of a place "100 St Lantana St, Los Angeles, Calif." are received or when a navigation apparatus runs a query "Would you like to calculate a route to St Lantana St?" to start guidance-route computation, as shown in FIG. 3C, a conversion rule is defined in many cases so that "St" in the character strings "St Lantana St" is pronounced "sutorîto".

In this case, therefore, "St Lantana St", which is supposed to be pronounced "sento lantana strît", is converted into speech "strît lantana strît". On the other hand, when the conversion rule is defined so that "St" is pronounced "sento", it is converted into speech "sento lantana sento". In this manner, "St", which is widely used for place names, may be pronounced "sento" other than "strît". A dictionary as described above cannot distinguish between the pronunciations "sento" and "strît".

SUMMARY OF THE INVENTION

Accordingly, a main object of the present invention is to provide a speech-conversion processing apparatus that can reliably perform speech conversion even when a word that is pronounced in multiple ways (which word cannot be properly dealt with by conventional dictionaries) is contained in character strings containing words indicating place names.

In order to overcome the problem described above, the present invention provides a speech-conversion processing apparatus. The speech-conversion processing apparatus includes: an address character-string structure analyzer for analyzing an address character-string structure with respect to address data selected from input data for speech conversion, in accordance with address speech-conversion application rule data; a specific-element speech-conversion pronunciation-symbol dictionary in which data associated with speech-conversion pronunciation symbols is stored with respect to character strings of a specific element of the address character-string structure; and an address speech-conversion data reader for searching the specific-element speech-conversion pronunciation-symbol dictionary with respect to a character string of the specific element, the character string being obtained by dividing the address data into elements of address speech-conversion structure data based on a result of the analysis performed by the address character-string structure analyzer, and for reading data associated with speech-conversion pronunciation symbols. The speech conversion processing apparatus further includes: an address speech-conversion speech data creator for creating speech data of all elements of address character strings, in accordance with the data associated with the speech-conversion pronunciation symbols, the data being read by the address speech-conversion data reader; and a speech output section for generating, in speech form, the speech data created by the address speech-conversion speech data creator.

The specific element of the address character-string structure may be a street name, and the address speech-conversion data reader may search a street speech-conversion pronunciation-symbol dictionary in which data associated with speech-conversion pronunciation symbols are stored with respect to character strings of streets and performs reading.

The address speech-conversion rule data may include a state name, a city name, a street name, a road type, a street number.

The address speech-conversion rule data may include a facility name and the specific element speech-conversion pronunciation-symbol dictionary may include data of the facility name.

The data associated with the speech-conversion pronunciation symbols may be pronunciation symbols.

The data associated with the speech-conversion pronunciation symbols may be a reference list that refers to data containing speech-conversion pronunciation symbols.

The data containing the speech-conversion pronunciation symbols, the data being referenced by the reference list, may be processed by a processing section that performs speech-conversion processing by using a general dictionary.

The address speech-conversion application-rule data may be constituted by a plurality of pieces of address speech-conversion application-rule data, and the address character-string structure analyzer may select any of the data to analyze the address character-string structure.

The speech-conversion processing apparatus according to the present invention may further include an address speech-conversion application-rule data storage section for storing the address speech-conversion application-rule data and the address character-string structure analyzer may search the address speech-conversion application-rule data storage section to select any of the data.

With respect to a character string other than character strings of the specific element, the character strings being contained in the input address data, data for speech conversion may be searched for and read from at least one of a general dictionary, an individually-created/tailored general dictionary in which data associated with pronunciation symbols for data that are not stored in the general dictionary are stored, and an individually-created/tailored pronunciation-symbol dictionary in which pronunciation symbols for data that are not stored in the general dictionary are stored.

With respect to data other than the address data of the input data for speech conversion, data may be searched for and read from at least one of a general dictionary, an. individually-created general dictionary in which data associated with pronunciation symbols for data that are not stored in the general dictionary are stored, and an individually-created pronunciation-symbol dictionary in which pronunciation symbols for data that are not stored in the general dictionary are stored, the read data may be subjected to speech-conversion processing, and resulting data may be produced from the speech output section in conjunction with the speech-conversion-processed data of the address data.

The specific element of the address character-string structure may be an expressway number. The specific-element speech-conversion pronunciation-symbol dictionary may be an expressway-number space-processing pronunciation-symbol dictionary in which expressway numbers in which spaces are contained and pronunciation symbols are stored in association with each other. When a space is contained in an expressway number, the address speech-conversion data reader can read pronunciation symbols stored in the expressway-number space-processing pronunciation-symbol dictionary.

The specific element of the address character-string structure may be a state name. The specific-element speech-conversion pronunciation-symbol dictionary may be a state abbreviation/proper-name conversion dictionary in which state proper-names and corresponding state abbreviations are stored in association with each other. In the presence of a state abbreviation, the address speech-conversion data reader can read data associated with pronunciation symbols, the data being stored in the state abbreviation/proper-name conversion dictionary.

The data associated with the pronunciation symbols, the data being stored in the state abbreviation/proper-name conversion dictionary, may be pronunciation symbols for a proper name.

The data associated with pronunciation symbols, the data being stored in the state abbreviation/proper-name conversion dictionary, may be pronunciation symbols for a proper name and pronunciation symbols for the proper name may be stored in another dictionary. In the presence of a state abbreviation, the address speech-conversion data reader can search for a proper name from the state abbreviation/proper-name conversion dictionary and can read pronunciation symbols from the other dictionary in accordance with the proper name.

The specific-element speech-conversion pronunciation-symbol dictionary in which the data associated with the speech-conversion pronunciation symbols are stored may be data in which the data associated with the speech-conversion pronunciation symbols are stored in a different storage section.

The specific-element speech-conversion pronunciation-symbol dictionary in which the data associated with the speech-conversion pronunciation symbols are stored may be data incorporated in speech-conversion processing software.

The speech conversion processing apparatus may be applied to a navigation apparatus.

The configuration of the present invention makes it possible to reliably perform correct speech conversion even when a word that is pronounced in multiple ways, which word cannot be properly handled by conventional various types of dictionaries, is contained in character strings containing words indicating place names.

BRIEF DESCRIPTION OF THE DRAWINGS

FIGS. 3A to 3E show various actual examples in the first embodiment;

FIG. 4 shows examples of speech data for street-name speech conversion in the first embodiment;

FIGS. 6A and 6B show actual examples in the second embodiment;

FIGS. 9A and 9B show actual examples in the third embodiment; and

DESCRIPTION OF THE PREFERRED EMBODIMENTS

With the following configuration, the present invention achieves an object of reliably performing speech conversion even when a word that is pronounced in multiple ways, which word cannot be properly dealt with by conventional dictionaries, is contained in character strings containing words indicating place names. That is, the speech-conversion processing apparatus includes: an address character-string structure analyzer for analyzing an address character-string structure with respect to address data selected from input data for speech conversion, in accordance with address speech-conversion application rule data; a specific-element speech-conversion pronunciation-symbol dictionary in which data associated with speech-conversion pronunciation symbols are stored with respect to character strings of a specific element of the address character-string structure; and an address speech-conversion data reader for searching the specific-element speech-conversion pronunciation-symbol dictionary with respect to a character string of the specific element, the character string being obtained by dividing the address data into elements of address speech-conversion structure data based on a result of the analysis performed by the address character-string structure analyzer, and for reading data associated with speech-conversion pronunciation symbols. The speech conversion processing apparatus further includes: an address speech-conversion speech data creator for creating speech data of all elements of address character strings, in accordance with the data associated with the speech-conversion pronunciation symbols, the data being read by the address speech-conversion data reader; and a speech output section for generating, in speech form, the speech data created by the address speech-conversion speech data creator.

FIRST EXAMPLE

Figure 1:
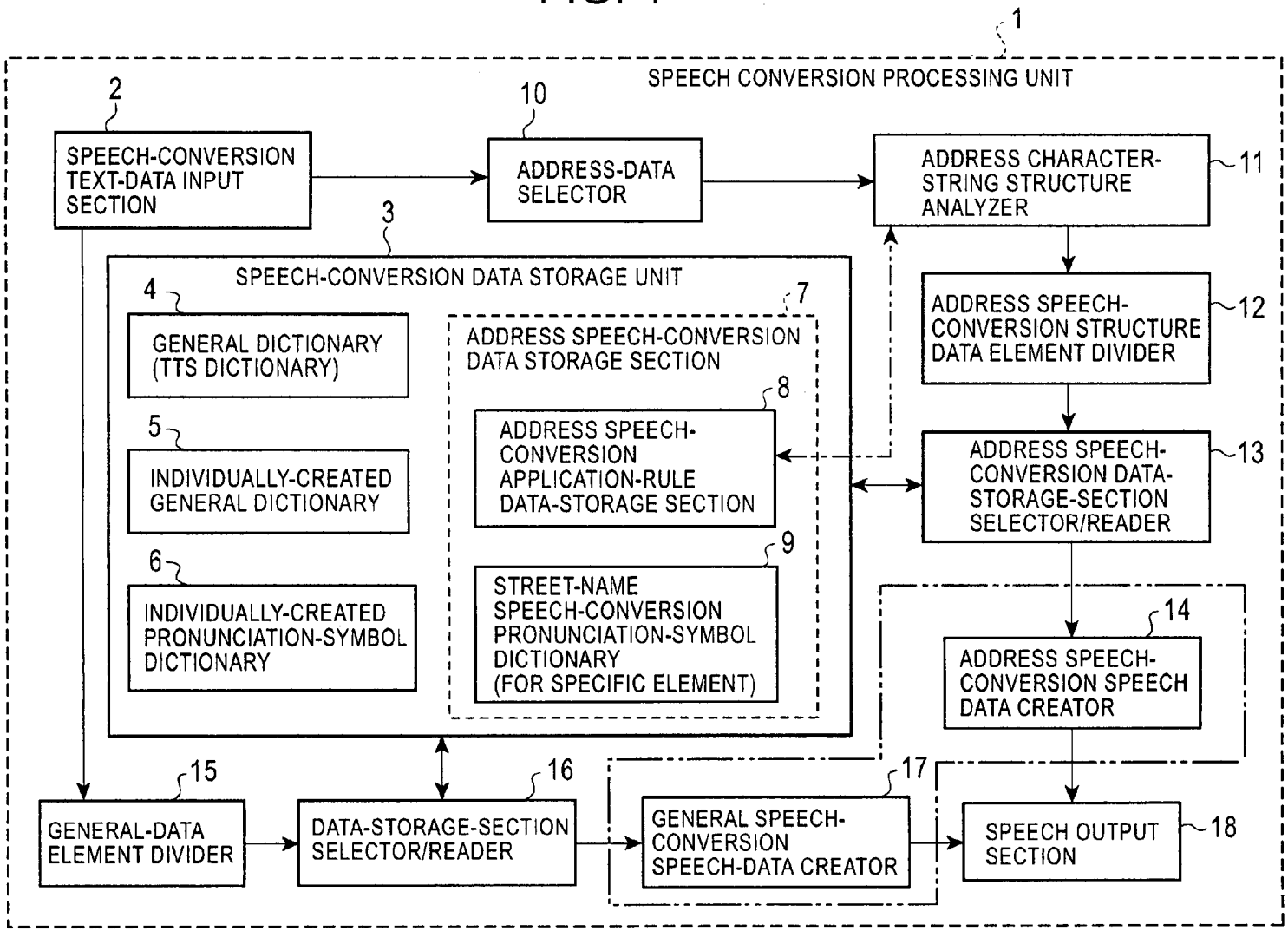
FIG. 1 is a functional block diagram of a first embodiment of the present invention.

Embodiments of the present invention will be described with reference to the accompanying drawings. FIG. 1 is a functional block diagram showing speech-conversion processing including address speech-conversion processing according to the present invention. Each functional section for achieving a corresponding function in FIG. 1 can also be regarded as means for achieving each function. In the speech-conversion processing example shown in FIG. 1, a speech-conversion processing unit 1 includes an input section 2 (hereinafter referred to as "speech-conversion text-data input section 2") to which text data for speech conversion is entered/received. In the embodiment shown in FIG. 1, of various types of text data that are sent to the speech-conversion text-data input section 2 and that are to be converted into speech, an address-data selector 10 selects text data input in a specific address read-aloud state. Examples of the text data selected in this case include text data received when an address for input confirmation is read aloud after a destination is entered into a navigation apparatus; text data for response to a query on the point where the vehicle is currently traveling; and text data received in a specific address read-aloud state, such as text data received when a guidance-route destination calculated before the calculation of its guidance route is confirmed. Other text data are sent to a general-data element divider 15.

The speech-conversion processing unit I shown in FIG. 1 has a storage unit 3 for data for speech conversion (hereinafter referred to as "speech-conversion data storage unit 3). Data used for converting text data into speech are stored in the speech-conversion data storage unit 3. In the illustrated example, the speech-conversion data storage unit 3 includes a general dictionary 4, which serves as a TTS (text-to-speech) dictionary in which the text data of most basic and widely-used words are stored in association with corresponding pronunciation symbols. The TTS dictionary serves as a main dictionary for a TTS engine, manufactured for general purposes, for performing speech-conversion processing and performs most efficient speech-conversion processing in accordance with a program for the TTS engine.

When the TTS engine is used for, for example, a navigation apparatus, unique words used by the navigation apparatus, the proper pronunciations of abbreviations (e.g., "St" represents "Street", as in the TTS dictionary shown in FIG. 3B), and so on that are not stored in the general dictionary 4 serving as a TTS dictionary can be stored in an individually-created general dictionary 5. The individually-created general dictionary 5 has functions similar to those of the TTS dictionary, used for basic processing of the TTS engine, and assists the general dictionary 4. In the example shown in FIG. 1, the speech-conversion data storage unit 3 further includes an individually-created pronunciation-symbol dictionary 6 in which words that are not stored in the dictionaries described above but are desired to be stored are stored in association with pronunciation symbols. For example, as shown in FIG. 3A, pronunciation symbols for plain text are stored. Although pronunciation symbols used herein are based on the so-called Romaji for convenience, they may be of any type of symbols that can appropriately represent pronunciations.

The speech-conversion data storage unit 3 in the present invention further includes a data storage section 7 for address speech conversion (hereinafter referred to as "address speech-conversion data storage section 7"), particularly, in order to accurately convert address text data, selected by the address-data selector 10, into speech. In the illustrated example, the address speech-conversion data storage section 7 includes an address speech-conversion application-rule data storage section 8 and a pronunciation-symbol dictionary 9 for street-name speech-conversion (hereinafter referred to as "street-name speech-conversion pronunciation-symbol dictionary 9"). Various types of address character-string structure, for example, a structure constituted by "state, city, street, road type, St number, facility (POI: point of interest) name" as shown in FIG. 3D or a structure "prefecture, city/town, block number, facility name (POI)", are stored in the address speech-conversion application-rule data storage section 8. In the present invention, not only mere addresses as described above but also facility (POI) names can be handled in the same manner as address elements, such as streets.

The address text data selected by the address-data selector 10 is sent to an address character-string structure analyzer 11. Depending on the situation in which the dictionary is used, the address character-string structure analyzer 11 selects an appropriate structure type, for example, "state, city, street, road type, street number" from the address speech-conversion application-rule data storage section 8, applies the structure type to the input text data, and performs analysis. In the address text data example shown in FIG. 3C, based on the analysis result, an address speech-conversion structure data element divider 12 divides the text data into "City Bank", "100", "St Lantana St", "Los Angeles", and "California", which constitute the address, in accordance with predetermined conversion application rules.

For example, when the text data has character strings "St Lantana St", as described above, it is necessary to ensure that the former "St" is pronounced "sento" and the latter "St" is pronounced "sutorîto". For this purpose, "St Lantana" is stored in the street-name speech-conversion pronunciation-symbol dictionary 9 so that it is pronounced "sento lantana", even when "St" is stored in the general dictionary 4 or the individually-created general dictionary 5 so that it is converted into "sutorîto". For example, of text data for street names that are each pronounced in different ways depending on a use state even for the same text data, text data for street names whose pronunciations are not stored (as illustrated in FIG. 3E) in the general dictionary and so on are stored in the street-name speech-conversion pronunciation-symbol dictionary 9.

As such street-name speech-conversion pronunciation symbols, for example, pronunciation symbols for text data, as shown in FIG. 4, are stored in addition to those as described above. With this arrangement, for a character-string portion of a street element, a storage section selector/reader 13 for data for address-speech conversion (hereinafter referred to as "address speech-conversion data-storage-section selector/reader 13)" can search the street-name speech-conversion pronunciation-symbol dictionary 9 by priority, as described below. Thus, it is possible to perform accurate read-aloud/voice guidance. Although FIG. 1 particularly shows an example in which the speech-conversion pronunciation-symbol dictionary 9 for street elements are provided for the elements of an address character-string structure, a similar dictionary can also be provided for another type of representation. Thus, the speech-conversion pronunciation-symbol dictionary 9 can generally be called a speech-conversion pronunciation-symbol dictionary for specific elements. This dictionary also may contain data of facility (POI) names as described above.

As described above, the speech-conversion data storage unit 3 is provided in the present invention. Thus, the apparatus can be pre-set so that, when the input text data has a character string corresponding to the "street" element of an address character-string structure read from the address speech-conversion application-rule data storage section 8, the address speech-conversion data-storage-section selector/reader 13 searches the street-name speech-conversion pronunciation-symbol dictionary 9 and reads pronunciation symbols for the character string. By doing so, with respect to "St Lantana" corresponding to the "street" name in the example of FIG. 3D, pronunciation symbols "sento lantana" stored in the street-name speech-conversion pronunciation-symbol dictionary 9 can be read for correct pronunciation.

With respect to the character strings of other elements, the address speech-conversion data-storage-section selector/reader 13 searches other dictionaries to thereby obtain pronunciation symbols therefor and sends the pronunciation symbols to a speech-data creator 14 for address speech-conversion (hereinafter referred to as "address speech-conversion speech data creator 14"). Character strings that are not included in any dictionary are sent to the address speech-conversion speech-data creator 14 without change. The address speech-conversion speech-data creator 14 obtains pronunciation symbols for all address character-strings or receives character strings sent without change, as described above, and converts the received pronunciation symbols or character strings into speech. The address speech-conversion speech-data creator 14 and a general speech-conversion speech-data creator 17, which converts general text data into speech and which is described below, are separately shown in FIG. 1. However, in an actual TTS engine, they may be integrated with each other.

When a character string sent without change is received by the address speech-conversion speech-data creator 14, as described above, it is read according to a predetermined pronunciation, for example, English characters "Xz" are read "ekszî" with an ordinary pronunciation. The speech data is subjected to intonation processing, tone processing, and so on, as appropriate, and the resulting data is produced from a speech output section 18.

In the speech-conversion processing unit 1 shown in FIG. 1, when various types of text data other than address data as described above are sent to the speech-conversion text data input section 2, the general-data element divider 15 divides the text data into elements each substantially corresponding to a word. Thereafter, using a predetermined scheme, a data-storage-section selector/reader 16 selects the general dictionary 4 serving as a TTS dictionary, the individually-created general dictionary 5 serving as an individually-created TTS dictionary, the individually-created pronunciation-symbol dictionary 6, and so on, which are included in the speech-conversion data storage unit 3, and reads pronunciation symbols. The general speech-conversion speech-data creator 17 creates speech data in accordance with the read pronunciation symbols. The general audio-conversion audio-data creating unit 17 then performs various types of processing, such as intonation processing and tone processing, in the same manner as described above, as required, and produces the resulting data via the speech output section 18. The general speech-conversion speech-data creator 17 may also be integrated with the address speech-conversion speech-data creator 14, as described above.

Figure 2:
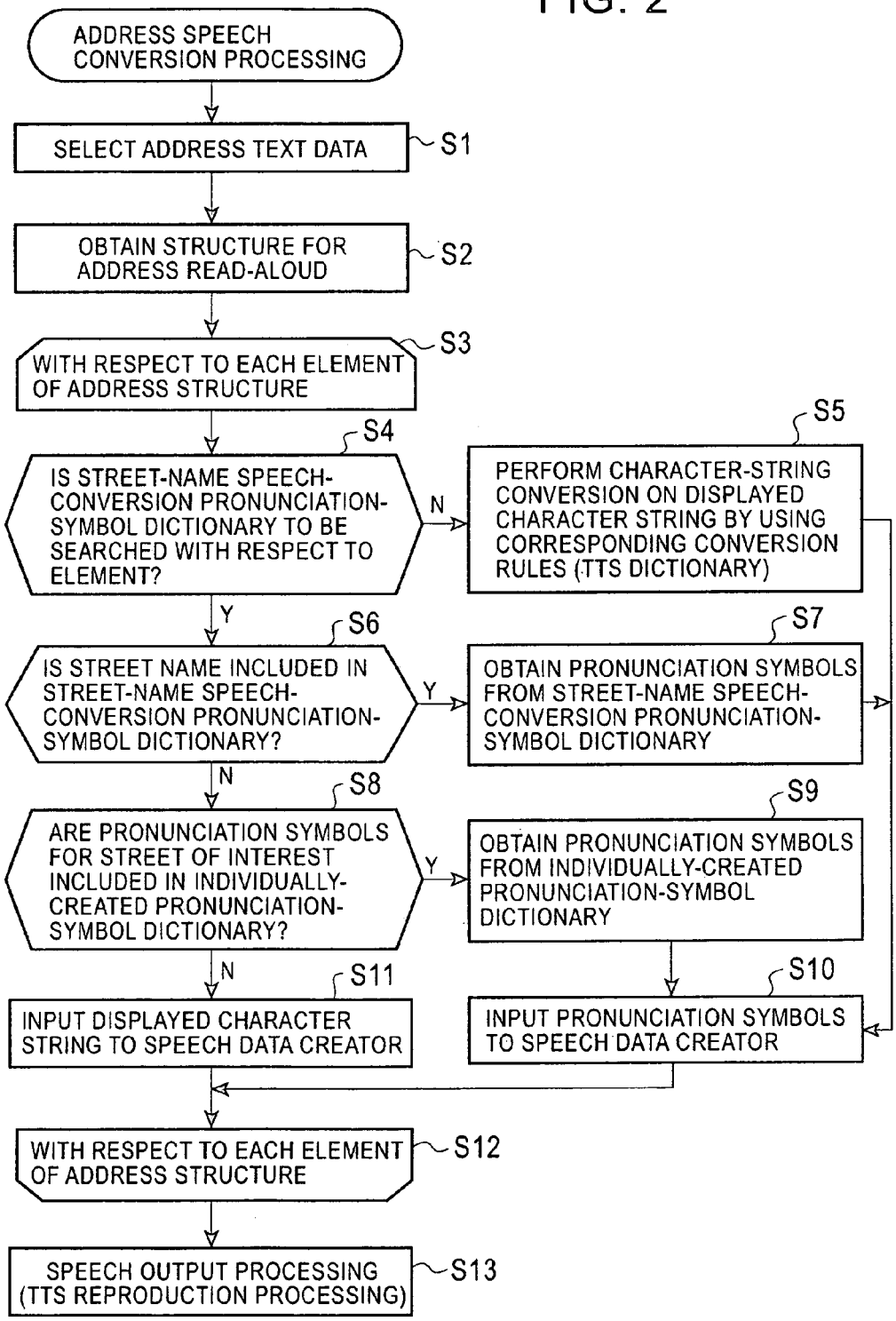
FIG. 2 is an operation flow diagram of the first embodiment.

In the speech-conversion processing apparatus having the functional blocks described above according to the embodiment of the present invention, particularly, the address speech-conversion processing performed by the address-data selector 10 to the address speech-conversion speech-data creator 14 in FIG. 1 can be performed sequentially in accordance with, for example, an operation flow shown in FIG. 2. In the address speech-conversion processing shown in FIG. 2, first, address text data is selected (in step S1).

In this operation, of various types of text data for speech conversion which are sent to the speech-conversion text-data input section 2, the address-data selector 10 selects address-data portion of text data by analyzing the text syntax to thereby select address data. Examples of the text address-portion data selected in this case include address-portion data of text data entered when an address for input confirmation is read aloud after a destination is entered via a navigation apparatus; address-portion data of text data for response to a query on the point where the vehicle is currently traveling; and address-portion data of text data entered/received in a specific address read-aloud state, such as address-portion data of text data entered/received when a guidance-route destination calculated before the calculation of its guidance route is confirmed.

Next, a structure for address read-aloud is obtained with respect to address text data entered/received as described above (in step S2). In this operation, the structure is obtained by causing the address character-string structure analyzer 11 shown in FIG. 1 to select an address structure type, as described above, stored in the address speech-conversion application-rule data storage section 8. In combination with the structure, address character-strings are created. Thus, for example, an address structure type as shown in the left column in FIG. 3D is applied to address text data as shown in FIG. 3C. In this operation, based on a result of the analysis performed by the address character-string structure analyzer 11 shown in FIG. 1, the address speech-conversion structure data element divider 12 divides the text data into elements.

In the example shown in FIG. 2, processing as described below is performed with respect to each element of the address structure (in step S3). A determination is then made as to whether or not the street-name speech-conversion pronunciation-symbol dictionary 9 is to be searched with respect to the element (in step S4). This determination can be made by causing the address speech-conversion data-storage-section selector/reader 13 to determine whether or not each element obtained by dividing the elements of the input character strings in accordance with the address character-string structure is a "street name".

When it is determined in step S4 that the street-name speech-conversion pronunciation symbol dictionary 9 is not to be searched with respect to the element, character-string conversion is performed on the displayed character string by using the TTS dictionary, which defines a corresponding conversion rule (in step S5). Specifically, in this operation, upon determining that each element of the input character strings is not a street name, the address speech-conversion data-storage-section selector/reader 13 shown in FIG. 1 refers to and reads data of the general dictionary 4, which serves as a TTS dictionary in the speech-conversion data storage unit 3. During the operation, the address speech-conversion data-storage-section selector/reader 13 can also refer to and read data of the individually-created general dictionary 5 and the individually-created pronunciation-symbol dictionary 6, as needed.

When it is determined in step S4 that the street-name speech conversion pronunciation symbol dictionary 9 is to be searched with respect to the element, that is, that the element corresponds to a street name, a determination is made (in step S6) as to whether or not the street name is included in the street-name speech-conversion pronunciation-symbol dictionary 9. This determination can be made by causing the address speech-conversion data-storage-section selector/reader 13 shown in FIG. 1 to determine whether or not the character string is stored in the street-name speech conversion pronunciation symbol dictionary 9.

When it is determined in step S6 that the street name is included in the street-name speech-conversion pronunciation-symbol dictionary 9, corresponding pronunciation symbols are obtained from the street-name speech-conversion pronunciation-symbol dictionary 9 (in step S7). This operation can be performed by causing the address speech-conversion data-storage-section selector/reader 13 shown in FIG. 1 to read and obtain pronunciation symbols corresponding to the character string, the pronunciation symbols being stored in the street-name speech-conversion pronunciation-symbol dictionary 9.

When it is determined in step S6 that the street name is not included in the street-name speech-conversion pronunciation-symbol dictionary 9, a determination is made (in step S8) as to whether or not pronunciation symbols for the street name of interest are included in the individually-created pronunciation-symbol dictionary 6. This determination can be made by causing the address speech-conversion data-storage-section selector/reader 13 shown in FIG. 1 to determine whether or not the street name is stored in the individually-created pronunciation-symbol dictionary 6. When it is determined that the street name is included in the individually-created pronunciation-symbol dictionary 6, pronunciation symbols for the street name are obtained from the individually-created pronunciation-symbol dictionary 6.

When character-string conversion is performed on the displayed character string by using the TTS dictionary (which defines a corresponding conversion rule) in step S5, when pronunciation symbols are obtained from the street-name speech-conversion pronunciation-symbol dictionary 9 in step S7, or when pronunciation symbols are obtained from the individually-created pronunciation-symbol dictionary 6 in step S9, the pronunciation symbols are sent to the speech-data creator (in step S10). This speech-data creator is implemented with the address speech-conversion speech-data creator 14 (shown in FIG. 1) for address speech-conversion processing, but may be integrated with the general speech-conversion speech-data creator 17.

When it is determined in step S8 that pronunciation symbols for the street name of interest are not included in the individually-created pronunciation-symbol dictionary 6, the displayed character string is sent to the TTS dictionary 4 without change (in step S11). Thereafter, at the same time when the pronunciation symbols are sent to the speech data creator in step S10 described above, with respect to each element of the entire address structure (in step S12), speech output processing, which is TTS reproduction processing, is performed (in step S113).

For cases in which correct pronunciation cannot be performed due to the presence of multiple pronunciations for the same text, particularly, for street names to which such cases are likely to happen, the description for the above embodiment has been given of an example in which street names whose pronunciations are not stored in the TTS dictionary are stored in the street-name speech-conversion pronunciation-symbol dictionary 9, an element portion corresponding to a street name is analyzed by an address character-string structure and is extracted, and a reference is made to the street-name speech-conversion pronunciation-symbol dictionary 9. When a similar thing happens to an element other than a street name portion, a speech-conversion pronunciation-symbol dictionary for the element may be further created so that pronunciation symbols therefore can be read with reference to the dictionary.

An example in which the street-name speech-conversion pronunciation-symbol dictionary 9 is included in the speech-conversion data storage unit 3 has been described in the above embodiment. The dictionary function can be achieved by forms other than the reference list shown in FIG. 3E. For example, the dictionary functionary can be accomplished by storing text data and pronunciation symbols in data reference sections in software, sequentially searching the data in accordance with a software flow, and producing pronunciation symbols when corresponding data exists. When the street-name speech-conversion pronunciation-symbol dictionary 9 is used, the data can be updated by updating only a corresponding portion, and when data is recorded in software, the data can be updated by overwriting the software.

SECOND EXAMPLE

As described above, when only an ordinary TTS dictionary is included in the speech-conversion data storage unit 3, particularly, a street name may not be correctly pronounced due to the presence of multiple pronunciations for the same text. For such a case, the description in first embodiment has been given of an example in which text having a special pronunciation is stored in association with corresponding pronunciation symbols, an address is divided into elements by using an address character-string structure, a street element is selected, and the stored data referred to. Also, as shown in FIG. 5, a street-name speech-conversion reference list 21 and a street-only TTS dictionary 22, which corresponds to the street-name speech-conversion reference list 21, may be provided in the speech-conversion data storage unit 3 so as to allow the TTS engine to perform speech-conversion processing in the same manner as the general TTS dictionary.

Figure 5:
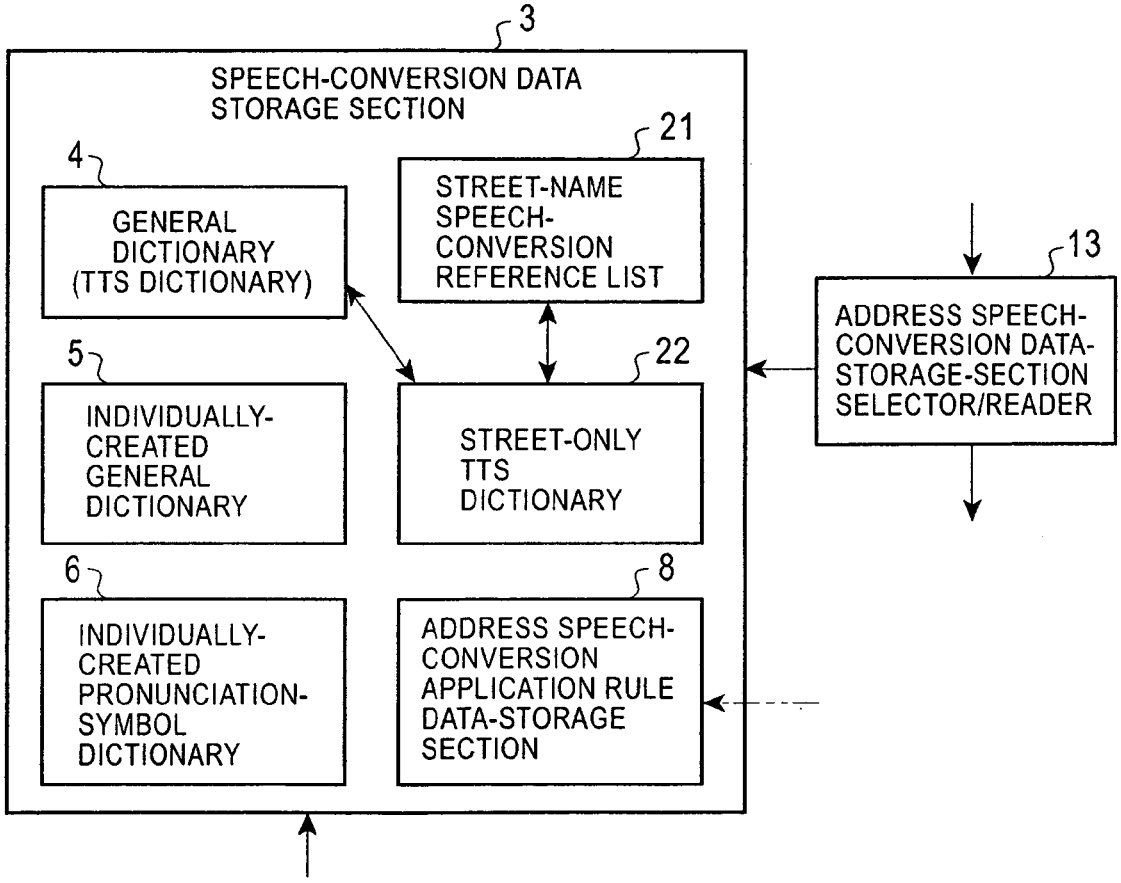
FIG. 5 is a diagram showing a major portion of functional blocks in a second embodiment of the present invention.

More specifically, in the example shown in FIG. 5, with respect to a street element of an address character-string structure as described above, the address speech-conversion data-storage-section selector/reader 13 shown in FIG. 1 can refer to the street-name speech-conversion reference list 21, in which data as shown in the street speech-conversion reference list shown in FIG. 6A are stored. Further, with respect to text data contained in the reference list 21, by using the street-only TTS dictionary 22 in which, for example, data as shown in FIG. 6B are stored, the address speech-conversion data-storage-section selector/reader 13 can perform searching by TTS processing, which is similar to typical speech conversion processing, to thereby obtain pronunciation symbols for speech conversion.

Figure 7:
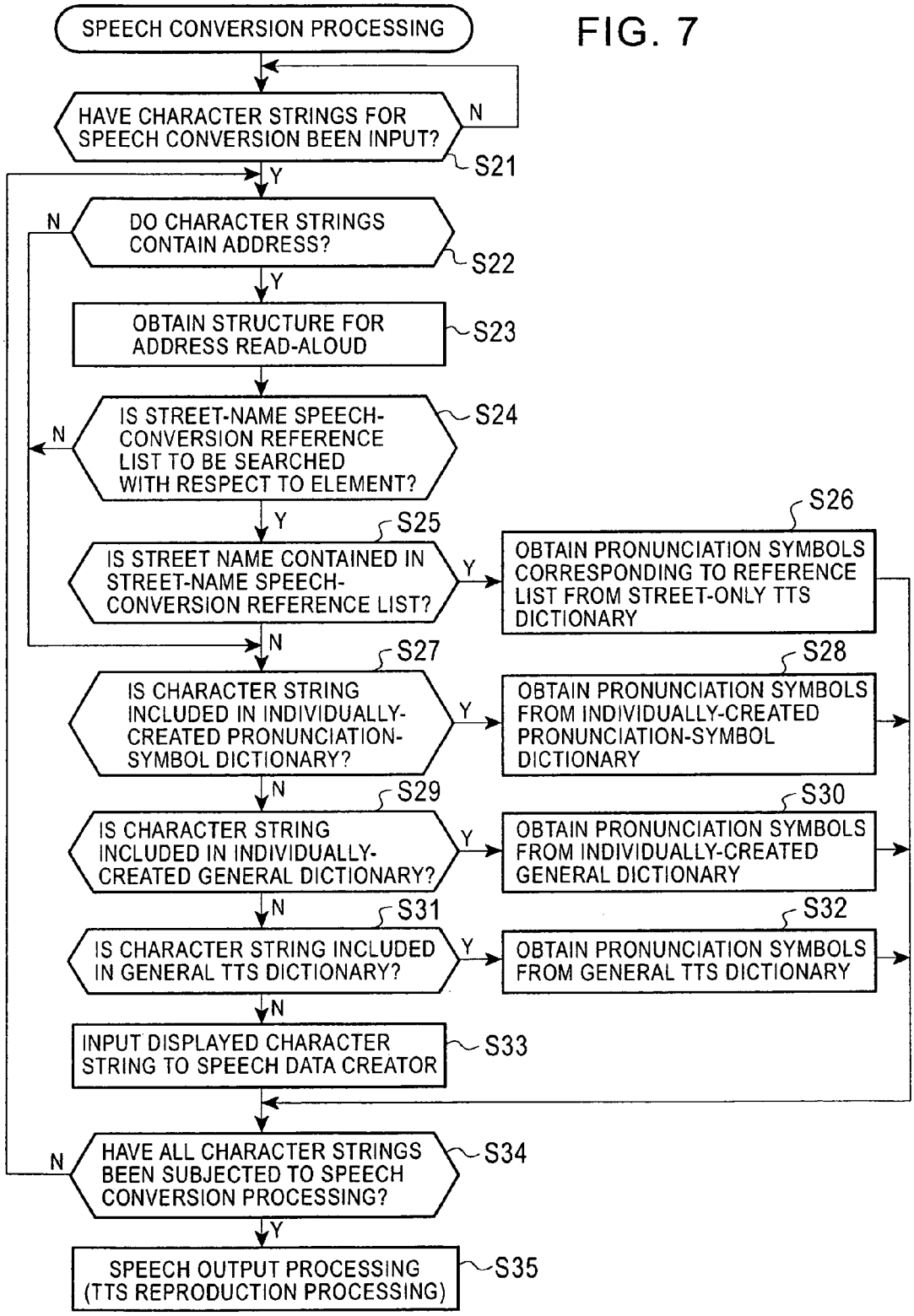
FIG. 7 is an operation flow diagram of the second embodiment.

Processing of the speech-conversion data storage unit 3 shown in FIG. 5 and a speech-conversion processing section that performs processing by using data obtained from the speech-conversion data storage unit 3 can be performed according to, for example, an operation flow shown in FIG. 7. Specifically, in an address-speech-conversion processing example shown in FIG. 7, first, a determination is made as to whether or not a character string or character strings for speech conversion have been entered/received (in step S21), and the process awaits until they are entered/received. When character strings are entered/received, a determination is made as to whether or not the character strings contain an address (in step S22). When it is determined that the character strings contain an address, a structure for address read-aloud/voice guidance is obtained (in step S23). The processing in steps S22 and S23 is analogous to the processing in steps S1 and S2 shown in FIG. 2. When the character strings do not contain an address, the process proceeds to step S27.

Next, a determination is made as to whether or not the street-name speech-conversion reference list 21 is to be searched with respect to each element of the character strings (in step S24). This determination is analogous to that in step S4 shown in FIG. 2. When it is determined in step S24 that the street-name speech-conversion reference list 21 is to be searched with respect to the element, that is, that the element corresponds to a street name, a determination is made as to whether or not the street name is included in the street-name speech-conversion reference list 21 (in step S25). This determination is made by causing, when the element of the address character-strings is a street name, the address speech-conversion data-storage-section selector/reader 13 to determine whether or not the element is a street name (e.g., as shown in FIG. 6A) included in the street-name speech-conversion reference list 21. When it is determined in that that the street-name speech-conversion pronunciation symbol dictionary 9 is not to be searched with respect to the element, the process proceeds to step S27.

When it is determined in step S25 that the street name is included in the street-name speech-conversion reference list 21, pronunciation symbols corresponding to the street-name speech-conversion reference list 21 is obtained from the street-only TTS dictionary. In this operation, when the street name is included in the street-name speech-conversion reference list 21, the address speech-conversion data-storage-section selector/reader 13 uses the street-only TTS dictionary 22, which is a portion of the TTS dictionary, to obtain pronunciation symbols at a corresponding number through a known TTS engine processing function.

When it is determined in step S25 in FIG. 7 that the street name is not included in the street-name speech-conversion reference list 21, when it is determined in step S22 that the character strings do not contain an address, or when it is determined in step S24 that the street-name speech-conversion pronunciation symbol dictionary 9 is not to be searched with respect to the element, similar processing is performed on the entire text data. Specifically, first, a determination is made as to whether or not each character string is included in the individually-created pronunciation-symbol dictionary 6 shown in FIG. 5 (in step S27). When the character string is included in the individually-created pronunciation-symbol dictionary 6, pronunciation symbols for the character string are obtained therefrom (in step S28). When it is determined that the character string is not included in the individually-created pronunciation-symbol dictionary 6, a determination is made (in step S29) as to whether or not the character string is included in the individually-created general dictionary 5, which can also serve as an TTS dictionary in FIG. 5. When the character string is included in the individually-created general dictionary 5, corresponding pronunciation symbols are obtained therefrom (in step S30).

When it is determined that the character string is not included in the individually-created general dictionary 5, either, a determination is made (in step S31) as to whether or not the character string is included in the general dictionary 4, which serves as a TTS dictionary in FIG. 5. When the character string is included in the general dictionary 4, corresponding pronunciation symbols are obtained therefrom (in step S32). On the other hand, when it is determined in step S31 that the character string is not included in the general dictionary 4, pronunciation symbols for the character string cannot be obtained from the speech-conversion data storage section 3, since the character string is not included in any of the dictionaries prepared in the speech-conversion data storage unit 3 shown in FIG. 5. Thus, the displayed character string is sent to the speech data creator without change.

Thereafter, a determination is made (in step S34) as to whether or not all character strings have been subjected to the speech-conversion processing, including cases in which pronunciation symbols for each character string are obtained in step S26, S28, S30, or S32 described above. For a character string that has not been subjected to the speech-conversion processing, the process returns to step S22 and the operation described above is repeated. When it is determined that all character strings have been subjected to the speech-conversion processing, speech output processing, which is TTS reproduction processing, is performed (in step S35).

In this embodiment, as a result of the above-described processing, extracting a street element obtained by dividing address data into address elements through the use of the address character-string structure and merely performing processing for referring to the reference list allows the TTS engine to efficiently perform speech-conversion processing using a general TTS dictionary. This arrangement can also improve the efficiency of the TTS engine.

Although an example in which a street element is subjected to speech processing using a reference list and dictionaries as described above through the use of an address character-string structure has been described in this embodiment as well, another type of element can also be efficiently subjected to speech processing using a similar reference list and dictionaries.

THIRD EXAMPLE

Figure 8:
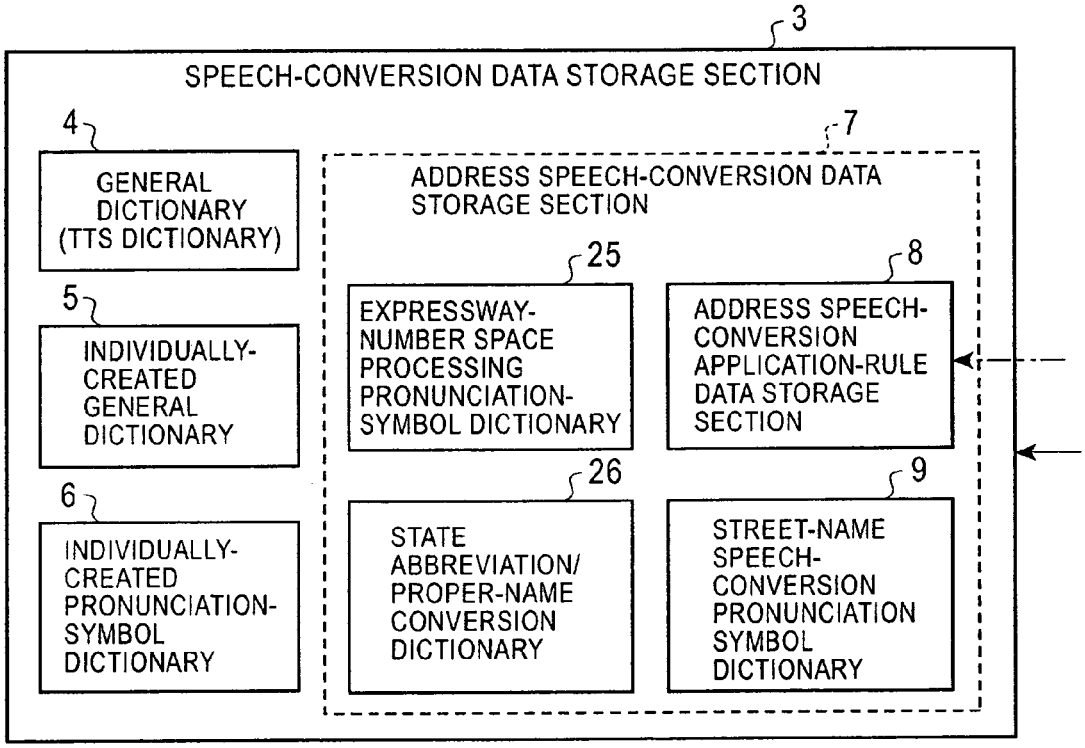
FIG. 8 is a diagram showing a major portion of functional blocks in a third embodiment of the present invention.

The present invention can also be implemented in another form using, for example, a speech-conversion data storage unit 3 as shown in FIG. 8. That is, in the example shown in FIG. 8, a pronunciation-symbol dictionary 25 for space processing of expressway numbers (hereinafter referred to as "expressway-number space-processing pronunciation-symbol dictionary 25") and a state abbreviation/proper-name conversion dictionary 26 are provided in addition to the dictionaries or the storage sections prepared in the speech-conversion data storage unit 3 shown in FIG. 1.

For example, as shown in FIG. 9A, when express numbers "1-110" and " I-1 10 (i.e., I-1 (space)10)" are stored in the expressway-number space processing pronunciation-symbol dictionary 25, in many cases, a known speech-conversion processing apparatus does not perform space processing for the expressway number, thereby making it difficult to distinguish between "I-110" and "I-1 10". Thus, in some cases, both are read as "I-1 10" (ai wan handoreddo ten) and thus "I-1 10" cannot be read as "ai wan ten".

In order to deal with such a problem, in the example shown in FIG. 8, pronunciation symbols for space processing, as shown in FIG. 9A, are stored in the expressway-number space-processing pronunciation-symbol dictionary 25. Further, when an element corresponding to an expressway number, the element being obtained by dividing address data into address elements through the use of an address character-string structure, is sent to the address speech-conversion data-storage-section selector/reader 13, searching is performed to determine whether or not the character string of the input element is included in the expressway-number space processing pronunciation-symbol dictionary 25. When the character string is included, pronunciation symbols for space processing are read and speech-conversion processing is performed.

In addition, state abbreviations and proper names as shown in FIG. 9B are stored in the state abbreviation/proper-name conversion dictionary 26 shown in FIG. 8 in association with each other, and pronunciation symbols are further stored as required. In many cases, the pronunciation symbols for state proper names are stored in the general dictionary 4 serving as a TTS dictionary or are, if not stored therein, stored in the individually-created general dictionary 5. Thus, those data can be used to obtain the pronunciation symbols. Thus, in the example shown in FIG. 9B, when "CA" exists at the character string of a "state" portion in the elements of an applied address character-string structure, the address speech-conversion data-storage-section selector/reader 13 searches the state abbreviation/proper-name conversion dictionary 26 and reads "California" stored therein, "California" being the proper name of "CA". Further, when pronunciation symbols "Kyaliforunia" are stored in the dictionary 26, the address speech-conversion data-storage-section selector/reader 13 can read the pronunciation symbols. When the proper names of state abbreviations of a country are stored in the dictionary, both the abbreviations and proper names of all the states of the country are stored in many cases.

Figure 10:
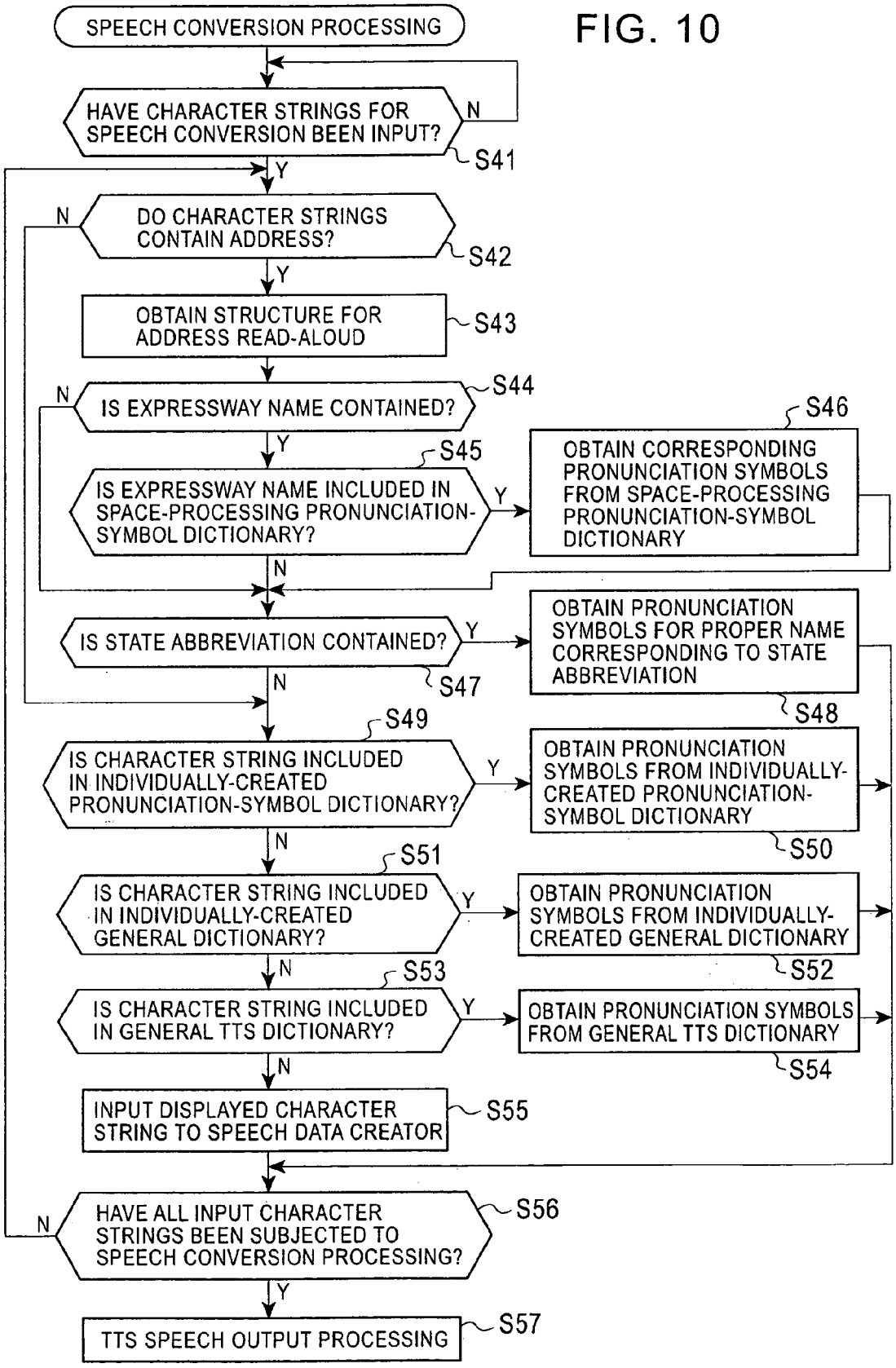
FIG. 10 is an operation flow diagram of the third embodiment.

In this example, the processing in this embodiment can be performed in accordance with, for example, an operation flow shown in FIG. 10. The operation flow in the example shown in FIG. 10 is analogous to that shown in FIG. 7. Steps S41 to S43 correspond to steps S21 to S23 shown in FIG. 7 and thus descriptions of the redundant steps will not be given below. In step S44, a determination is made as to whether or not an expressway name is contained in the input character strings. When no expressway name is contained, the process proceeds to step S47. When an expressway name is contained, a determination is made in step S45 as to whether or not the expressway name is included in the expressway-number space-processing pronunciation-symbol dictionary 25 (step S45). When the expressway name is included in the expressway-number space processing pronunciation-symbol dictionary 25, corresponding pronunciation symbols are obtained from the expressway-number space processing pronunciation-symbol dictionary 25 (in step S46).

Thereafter, when it is determined in step S45 that the expressway name is not included in the expressway-number space processing pronunciation-symbol dictionary 25, when corresponding pronunciation symbols are obtained from the expressway-number space processing pronunciation-symbol dictionary 25 in step S46, or when it is determined in step S44 that an expressway name is not contained in the character strings, a determination is made (in step S47) that a state abbreviation is contained in the character strings. When a state abbreviation is contained, referring to the state abbreviation/formal-name conversion dictionary 26 allows a corresponding proper name to be read, since the abbreviations and proper names for all the states are essentially stored in the state abbreviation/proper-name conversion dictionary 26 shown in FIG. 8. When corresponding pronunciation symbols are stored in the dictionary 26, the pronunciation symbols are read, and when corresponding pronunciation symbols are not stored, the pronunciation symbols can be read through the searching of the general dictionary 4, as described above.

In the example shown in FIG. 10, when it is determined in step S47 that the elements of the address character-string structure does not contain a state abbreviation or when it is determined in step S42 that the input character strings for speech conversion contain a character string containing an address, processing in steps S49 to S57, which are analogous to steps S27 to S35 in the operation flow shown in FIG. 7 is performed. Since the processing is the same as described above, the description thereof will not be given below.

While the present invention can be implemented with various modes as described above, the present invention is not limited thereto and can be implemented in various modes. For example, in the example shown in FIG. 8, the expressway-number space processing pronunciation-symbol dictionary 25 or the state abbreviation/proper-name conversion dictionary 26 may have, for example, an expressway-number space reference list or a state-abbreviation/proper-name conversion reference list in the same manner that the street-name speech-conversion reference list 21 shown in FIG. 5 is associated with the dedicated TTS dictionary serving as a TTS dictionary. In such a case, expressway-number pronunciation symbols or proper names and pronunciation symbols corresponding to the TTS dictionary can be stored.

The speech-conversion processing apparatus of the present invention can efficiently perform speech conversion processing, particularly, for addresses, and thus can be preferably used as a speech-conversion processing apparatus for navigation apparatuses. In addition, the speech-conversion processing apparatus of the present invention can be efficiently applied to various fields using speech-conversion processing apparatuses. Examples of the fields include a field in which road traffic information is provided and a field in which field voice guidance is performed during map searching using a personal computer or the like.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speech-conversion processing apparatus, comprising:

a character-string structure analyzer operable to analyze a character-string structure within address data selected for speech conversion in accordance with speech-conversion rule data to identify specific elements of an address, where the specific elements of the address of the character-string structure comprises a street name;

a general purpose dictionary in which text data of common words are stored in association with corresponding pronunciation symbols;

an individually-created general dictionary in which data associated with pronunciation symbols not stored in the general purpose dictionary is stored;

a pronunciation-symbol dictionary in which speech-conversion pronunciation symbols are specifically associated with character strings of a specific element of the address of the character-string structure, wherein the pronunciation-symbol dictionary comprises speech-conversion symbols specifically associated with character strings of street names;

a data reader operable to search the pronunciation-symbol dictionary, the individually-created general dictionary, and the general purpose dictionary, according to a predetermined scheme, for a character string of the specific element of the address, the character string being obtained by dividing the address data into the specific elements of the address based on a result of the analysis performed by the character-string structure analyzer, and to read data associated with the speech-conversion pronunciation symbols;

a speech data creator operable to create speech data for all the elements of address character strings in accordance with the data associated with the speech-conversion pronunciation symbols; and a speech generation section operable to generate speech from the speech data created by the speech data creator;

wherein in the predetermined scheme the pronunciation-symbol dictionary is searched first.

2. The speech-conversion processing apparatus according to claim 1, wherein the speech-conversion rule data further comprises a state name, a city name, a street name, a road type, a street number.

3. The speech-conversion processing apparatus according to claim 1, wherein the data associated with the speech-conversion pronunciation symbols comprises pronunciation symbols.

4. The speech-conversion processing apparatus according to claim 1, wherein the data associated with the speech-conversion pronunciation symbols comprises a reference list of speech-conversion pronunciation symbols.

5. The speech-conversion processing apparatus according to claim 4, wherein the speech-conversion pronunciation symbols referenced by the reference list are used by a processing section operable to perform speech-conversion processing by using the general purpose dictionary.

6. The speech-conversion processing apparatus according to claim 1, wherein the speech-conversion rule data further comprises a plurality of pieces of speech-conversion rule data, and the character-string structure analyzer selects one of the plurality of pieces of speech-conversion rule data to analyze the character-string structure.

7. The speech-conversion processing apparatus according to claim 6, further comprising a storage unit operable to store the speech-conversion rule data and the character-string structure analyzer searches the storage unit to select one of the plurality of pieces of speech-conversion rule data.

8. The speech-conversion processing apparatus according to claim 1, wherein data is searched for and read from at least one of the general purpose dictionary, the individually-created general dictionary in which data associated with pronunciation symbols not stored in the general dictionary is stored, and an individually-created pronunciation-symbol dictionary in which pronunciation symbol data not stored in the general dictionary is stored, the read data is subjected to speech-conversion processing, and resulting data is generated from the speech generating section in conjunction with the speech-conversion-processed address data.

9. The speech-conversion processing apparatus according to claim 1, wherein the specific elements of the address of the character-string structure comprises an expressway number; the pronunciation-symbol dictionary comprises a space-processing pronunciation-symbol dictionary in which expressway numbers having spaces are associated with pronunciation symbols; and when a space is contained in an expressway number, the data reader reads pronunciation symbols stored in the space-processing pronunciation-symbol dictionary.

10. The speech conversion processing apparatus according to claim 1, wherein the pronunciation-symbol dictionary comprises a state abbreviation/proper-name conversion dictionary in which state proper-names and corresponding state abbreviations are stored in association with each other; and wherein in the presence of a state abbreviation, the data reader reads data associated with pronunciation symbols stored in the state abbreviation/proper-name conversion dictionary.

11. The speech-conversion processing apparatus according to claim 10, wherein the data associated with the pronunciation symbols comprises pronunciation symbols for a proper name.

12. The speech-conversion processing apparatus according to claim 10, wherein the data associated with pronunciation symbols comprises pronunciation symbols for a proper name and pronunciation symbols for the proper name are stored in another dictionary; and in the presence of a state abbreviation, the data reader searches for a proper name from the state abbreviation/proper-name conversion dictionary and reads pronunciation symbols from the other dictionary in accordance with the proper name.

13. The speech conversion processing apparatus according to claim 1, wherein the pronunciation-symbol dictionary in which the data associated with the pronunciation symbols is stored comprises a storage section.

14. The speech-conversion processing apparatus according to claim 1, wherein the pronunciation-symbol dictionary in which the data associated with the pronunciation symbols is stored comprises data incorporated in speech-conversion processing software.

15. The speech conversion processing apparatus according to claim 1, wherein the speech conversion processing apparatus is part of a navigation apparatus.

16. A computer-implemented speech-conversion processing method, comprising:

analyzing, with a character-string structure analyzer, a character-string structure with respect to address data selected for speech conversion in accordance with address speech-conversion rule data to identify specific elements of an address, where the specific elements of the address of the character-string structure comprises a street name;

storing, in a general purpose dictionary, text data of common words in association with corresponding pronunciations symbols;

storing, in an individually-created general dictionary, data association with pronunciation symbols not stored in the general purpose dictionary;

storing, in a pronunciation-symbol dictionary, data specifically associated with pronunciation symbols corresponding to character strings within a specific element of the address of the character-string structure, wherein the pronunciation-symbol dictionary comprises speech-conversion symbols specifically associated with character strings of street names;

searching, with a data reader, the pronunciation-symbol dictionary, the individually-created general dictionary, and the general purpose dictionary, according to a predetermined scheme, for a character string within the specific element of the address, the character string being obtained by dividing the address data into the specific elements of the address in accordance with a result of the analysis of the character-string structure;

reading, with the data reader, data associated with pronunciation symbols;

creating, with a speech data creator, speech data for all elements of the character strings in accordance with the read data associated with the pronunciation symbols; and generating, with a speech generation section, speech from the speech data created;

wherein in the predetermined scheme the pronunciation-symbol dictionary is searched first.

* * * * *